US007489215B2

(12) United States Patent
Rottmoser et al.

(10) Patent No.: US 7,489,215 B2
(45) Date of Patent: Feb. 10, 2009

(54) HIGH FREQUENCY FILTER

(75) Inventors: Franz Rottmoser, Schechen (DE); Dietmar Sieraczewski, Flintsbach am Inn (DE); Wilhelm Watzenberger, Simbach am Inn (DE)

(73) Assignee: Kathrein-Werke KG, Rosenheim (DE)

( * ) Notice: Subject to any disclaimer, the term of this patent is extended or adjusted under 35 U.S.C. 154(b) by 75 days.

(21) Appl. No.: 11/667,864

(22) PCT Filed: Oct. 6, 2005

(86) PCT No.: PCT/EP2005/010781

§ 371 (c)(1),
(2), (4) Date: May 16, 2007

(87) PCT Pub. No.: WO2006/053607

PCT Pub. Date: May 26, 2006

(65) Prior Publication Data

US 2008/0007371 A1 Jan. 10, 2008

(30) Foreign Application Priority Data

Nov. 18, 2004 (DE) ..... 10 2004 055 707

(51) Int. Cl.
*H01P 1/205* (2006.01)
*H01P 1/202* (2006.01)

(52) U.S. Cl. ..... 333/206; 333/203; 333/134

(58) Field of Classification Search ..... 333/202, 333/203, 206, 134, 160, 222; 29/600
See application file for complete search history.

(56) References Cited

U.S. PATENT DOCUMENTS

| | | | | |
|---|---|---|---|---|
| 3,516,030 | A | 6/1970 | Brumbelow | |
| 4,216,448 | A | 8/1980 | Kasuga et al. | |
| 4,307,357 | A | 12/1981 | Alm | |
| 4,342,969 | A | 8/1982 | Myers et al. | |
| 5,894,250 | A | 4/1999 | Ravaska et al. | |
| 6,064,285 | A | 5/2000 | Harron et al. | |
| 6,611,183 | B1 | 8/2003 | Peters | |
| 6,933,804 | B2 * | 8/2005 | Rathgeber et al. | 333/134 |

FOREIGN PATENT DOCUMENTS

DE 2161792 6/1973

(Continued)

OTHER PUBLICATIONS

International Search Report mailed Dec. 27, 2005.
International Preliminary Examination Report (Jul. 2, 2007).
K.V. Puglia: "A General Design Procedure For Bandpass Filters Derived From Low Pass Prototype Elements: Part II," *Microwave Journal*, Tutorial, pp. 114, 116, 120 Jan. 2001.

(Continued)

*Primary Examiner*—Daniel D Chang
(74) *Attorney, Agent, or Firm*—Nixon & Vanderhye PC

(57) ABSTRACT

The invention relates to a high frequency filter of coaxial construction, comprising an outer conductor housing with a housing base and a housing wall, whereby several resonators are embodied in the outer conductor housing, each comprising an inner conductor tube, electrically-coupled to the housing base. At least one part of adjacent resonators are electrically-coupled to each other by means of at least one coupling opening in the outer conductor housing. Said filter is characterized in that one or more recesses are embodied in the housing base, between at least one part of the inner conductor tube of adjacent resonators.

23 Claims, 3 Drawing Sheets

FOREIGN PATENT DOCUMENTS

| | | | |
|---|---|---|---|
| DE | 4337079 | | 6/1994 |
| DE | 19901265 | | 6/2000 |
| EP | 964 473 | A1 | 12/1999 |
| EP | 986 126 | A2 | 3/2000 |
| JP | 07-245513 | | 9/1995 |

OTHER PUBLICATIONS

Ian Hunter: "Theory and Design of Microwave Filters," IEE Electromagnetic Waves Series 48, pp. 1-3, 2001.

* cited by examiner

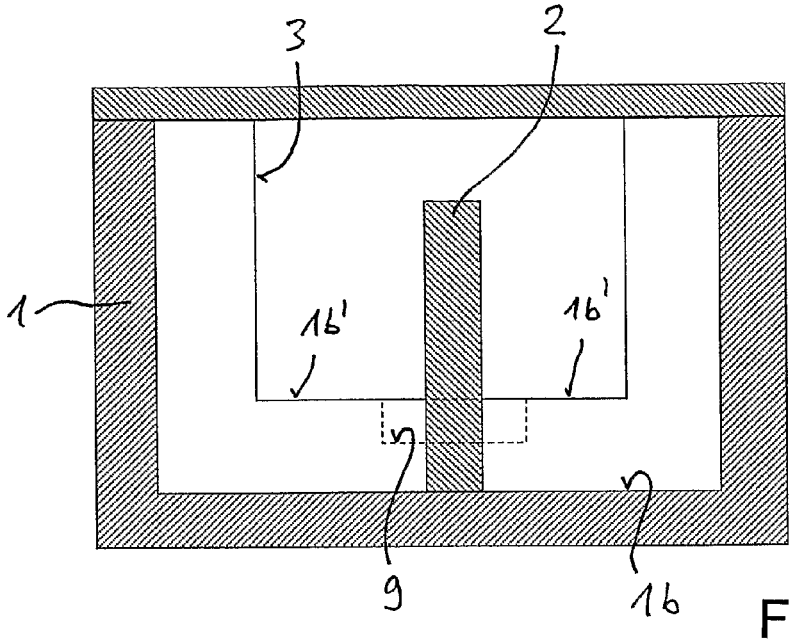
Fig. 5
Fig. 6
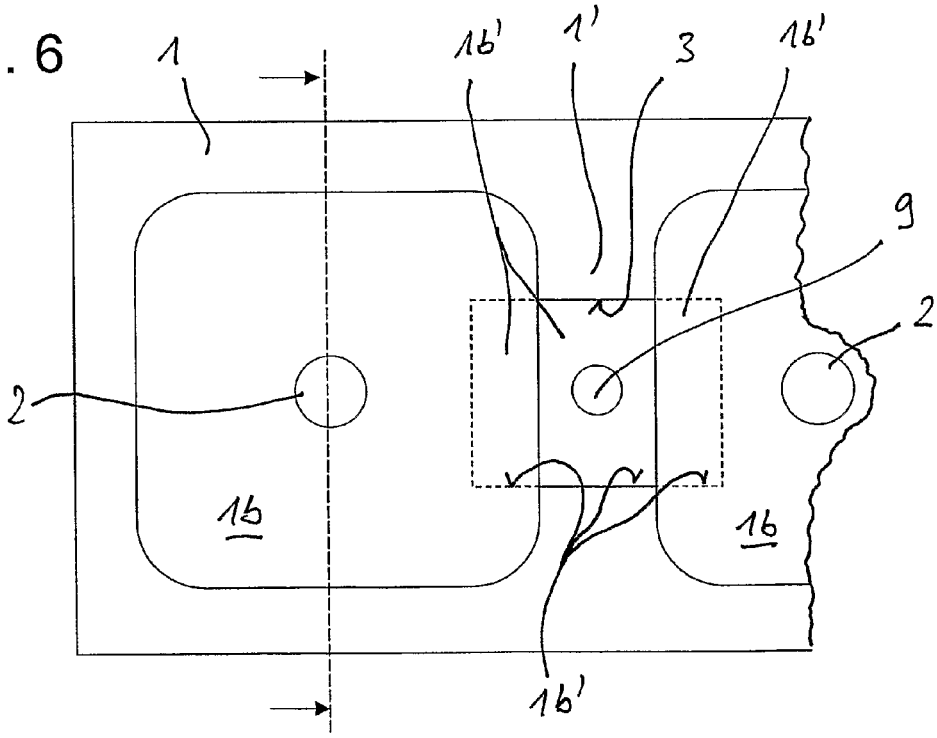

HIGH FREQUENCY FILTER

This application is the U.S. national phase of International Application No. PCT/EP2005/010781 filed 6 Oct. 2005 which designated the U.S. and claims priority to DE 10 2004 055 707.1 filed 18 Nov. 2004, the entire contents of each of which are hereby incorporated by reference.

The invention relates to a radiofrequency filter in coaxial design, particularly in the manner of a radiofrequency switch (for example a duplex switch) or a bandpass filter or bandstop filter. The invention furthermore relates to a method for tuning and/or producing a radiofrequency filter.

In radio-technology systems, for example in the mobile radio sector, a common antenna is often used for transmission and reception signals. The transmission and reception signals in this case use respectively different frequency ranges, and the antenna must be suitable for transmitting and receiving in the two frequency ranges. In order to separate the transmission and reception signals, suitable frequency filtering is therefore necessary with which on the one hand the transmission signals can be forwarded from the transmitter to the antenna, and on the other hand the reception signals can be forwarded from the antenna to the receiver. In order to split the transmission and reception signals, inter alia radiofrequency filters in coaxial design are currently used.

For example, a pair of radiofrequency filters may be used which both transmit a particular frequency band (bandpass filters). Alternatively, a pair of radiofrequency filters may be used which both block a particular frequency band (bandstop filters). Furthermore, a pair of radiofrequency filters may be used in which one filter transmits frequencies below a frequency between the transmission and reception bands and blocks frequencies above this frequency (lowpass filter) and the other filter blocks frequencies below a frequency between the transmission and reception bands and transmits frequencies lying above (highpass filter). Other combinations of the aforementioned filter types are also conceivable. Radiofrequency filters are often produced in the form of coaxial TEM resonators. These resonators can be manufactured cost-effectively and economically from machined or molded parts, and they ensure high electrical quality as well as relatively great temperature stability.

Coaxial resonator filters with a multiplicity of individual resonators coupled to one another are known from the publication "Hunter I. C. (Ian C.) Theory and design of microwave filters.—(IEE electromagnetic waves series; No. 48) 1. Microwave filters, ISBN 0 85296 777 2, Section 5.8".

Radiofrequency filters which comprise an outer conductor housing in which a plurality of coaxial cavities are formed, in which an inner conductor is respectively arranged in the form of an inner conductor tube, are known from the publication in "A General Design Procedure for Bandpass. Filters Derived from Low Pass Prototype Elements: Part II", K. V. Puglia, Microwave Journal, January 2001, pages 114 ff. In this case a multiplicity of resonators arranged next to one another are formed, neighboring resonators being electrically coupled to one another via coupling openings. The outer conductor housing of such radiofrequency filters is nowadays usually produced by molding or machining technology, in which case the desired response of the filter can be generated by corresponding selection or size and shape of the coupling openings and the distance between neighboring resonators. Since tolerances may occur in the production of such radiofrequency filters, it is generally necessary to mechanically finish the outer conductor housing. The finishing is usually carried out by machining the coupling openings. A disadvantage encountered in this case is that the coupling openings can only be enlarged when finishing the filter, which leads to reinforcement of the electrical coupling between neighboring resonators. In particular, it is no longer possible for a coupling opening machined too large to be reduced again, in order to lessen the electrical coupling. Previously, therefore, the coupling openings have always been designed to be too small, and the electrical coupling has been adjusted to the desired degree by successive re-machining. Production and tuning of the filter has therefore been very elaborate and time-consuming. In particular, it has been necessary to take care that the coupling opening is not machined too large, since this error was no longer correctable and the corresponding outer conductor housing has had to be discarded rejected.

A filter employing coaxial resonators has been disclosed, for example, by U.S. Pat. No. 4,307,357. There, for example, it is described that the wall holes in the housing, which connect the individual coaxial resonators, need not extend to the bottom level of an individual coaxial resonator but that the bottom surface here may extend at a different level, for example lying higher in this region than the normal bottom level so that a kind of pedestal, threshold, step etc. is formed.

DE 43 37 079 C2 has disclosed a coaxial comb line filter which comprises a housing with a cavity, in which rods are arranged. Each rod is formed continuously at one end with the housing. The other end of the rod extends into the cavity and ends at a particular position relative to the lid.

A filter for very short electromagnetic waves has been disclosed by DE 21 61 792 B2.

On the basis of the latter two radiofrequency filters forming the generic type, it is an object of the invention to provide a radiofrequency filter improved relative thereto, which can be produced with little outlay and more cost-effectively. It is furthermore an object of the invention to provide a simpler and less expensive tuning and/or production method for a radiofrequency filter.

This object is achieved by the independent patent claims. Refinements of the invention are defined in the dependent claims.

The radiofrequency filter according to the invention comprises an outer conductor housing with a housing bottom and a housing wall, in which a plurality of resonators are formed that respectively comprise an inner conductor tube electrically coupled to the housing bottom. At least some of neighboring resonators are electrically coupled to one another via at least one coupling opening in the outer conductor housing, the electrical coupling between neighboring resonators being influenced not only via the size and/or shape of the coupling openings, but also via one or more indentations. These indentations are formed between at least some of the inner tubes of neighboring resonators in the housing bottom.

The invention is based on the discovery that such indentations lead to attenuation of the electrical coupling between neighboring resonators. The degree of coupling is determined by the lateral extent and by the depth of the indentations. It is therefore possible for tolerances, occurring during manufacture of the filter, to be compensated for not only by enlarging the coupling opening but also by applying indentations between neighboring inner conductor tubes. In particular, an outer conductor housing with a coupling opening machined too large does not need to be rejected, since the electrical coupling which is too strong because of the excessively large coupling opening can be reduced again via corresponding indentations in the housing bottom.

The radiofrequency filter according to the invention can therefore be tuned and produced with little processing outlay. The filter may in particular also be tuned iteratively, i.e. the coupling between neighboring resonators may be tuned alternately by enlarging the coupling openings and applying indentations until the desired frequency response is achieved. The filter according to the invention is also substantially less expensive, since fewer rejects are incurred during its production. The development time for the filter is furthermore reduced, and an inexpensive molding tool can be used for the outer conductor housing.

Particularly effective attenuation of the coupling is achieved in a preferred embodiment of the filter according to the invention in that one or more of the indentations in plan view of the housing bottom lie next to a coupling opening and/or at least partially inside a coupling opening between two neighboring resonators. In particular, for at least some of neighboring resonators in plan view of the housing bottom at least 50%, in particular between 70% and 100%, preferably between 80% and 100% of the area of one or more of the indentations, which are formed between two inner conductor tubes of neighboring resonators, lie inside the at least one coupling opening between the neighboring resonators.

In another embodiment, between at least some of the inner conductors of neighboring resonators, a plurality of indentations are formed which are arranged next to one another in the longitudinal direction of the outer conductor housing and/or next to one another in the transverse direction of the housing and/or mutually offset in the longitudinal and/or transverse direction.

The indentations arranged in the housing bottom may have any shapes and depth profiles. In particular the indentations may be designed to be circular, rectangular, for example square and/or star-shaped in plan view of the housing bottom. The indentations may, however, have any other shape. The depth profile of the indentations may, for example, be V-shaped and/or U-shaped. Furthermore, the depth profile of one or more of the indentations may taper and/or widen downward. Other possible shapes of the depth profile are cylindrical, conical or spherical cap shapes. Preferably, the indentations are bores and/or machined holes in the housing bottom.

In one embodiment of the radiofrequency filter according to the invention, at least some of the inner conductor tubes are DC-connected to the housing bottom at their lower ends and they preferably have a cylindrical and/or rectangular and/or hexagonal or polygonal shape. The mechanical length of the individual inner conductor tubes is in particular essentially ¼ of the wavelength of the resonant frequency of the respective resonators.

In order to produce a radiofrequency filter with a closed outer conductor house, in a particularly preferred embodiment of the invention an electrically conductive lid is arranged on the upper side of the outer conductor housing. The resonators of the filter according to the invention are preferably configured and coupled so that a duplex switch or a bandpass filter or a bandstop filter is formed. Furthermore, the filter is in particular configured so that it operates in the mobile radio frequency range, particularly in the GSM and/or UMTS mobile radio frequency range.

Besides the radiofrequency filter described above, the invention furthermore relates to a method for tuning the radiofrequency properties of a radiofrequency filter, in particular the electrical coupling of the resonators of a radiofrequency filter, one or more indentations in the housing bottom being formed between at least some of the inner conductors of neighboring resonators in order to attenuate the electrical coupling of neighboring resonators. In this way, a possibility for tuning the filter in order to attenuate electrical coupling is made possible in a particularly straightforward way. Preferably, the indentations are bored and/or machined in the housing bottom. Furthermore, the tuning method preferably comprises as a further method step the enlargement of one or more of the coupling openings in the outer conductor housing, in particular milling of the coupling openings, so that the electrical coupling between neighboring resonators is reinforced. The desired frequency response can thus be adjusted iteratively, the electrical coupling on the one hand being increased by enlarging the coupling openings and, on the other hand, reduced by the formation of corresponding indentations in the housing bottom.

The invention furthermore relates to a production method for a radiofrequency filter, the filter being tuned at the end of the method with the aid of the tuning method described above. Production of the filter is greatly simplified in this way. In particular, fewer rejects are produced since excessive electrical coupling due to an excessively large machined opening can be compensated for by corresponding indentations in the housing body.

Exemplary embodiments of the invention will be described in more detail below with the aid of the appended figures, in which:

FIG. 5 shows a plan view analogous to FIG. 1 of a modified exemplary embodiment in detail; and FIG. 6 shows a cross-sectional representation along the line VI-VI in FIG. 5.

Figure 1:
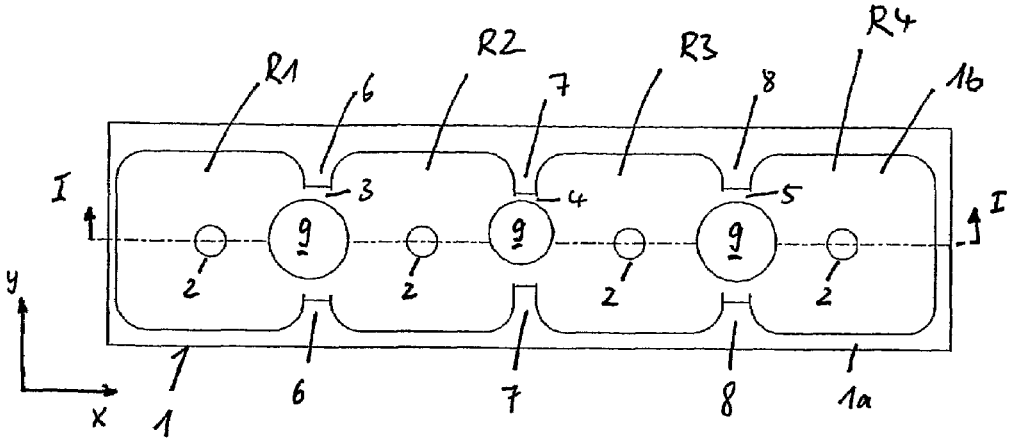
FIG. 1 shows a plan view of an embodiment of an inventive measure radiofrequency filter.

In plan view from above, FIG. 1 shows a radiofrequency filter in the form of a four-loop microwave filter. The filter comprises an electrically conductive outer conductor housing 1, which is preferably a machined or molded part. The outer conductor housing comprises a rectangular housing bottom 1*b* and a circumferential side wall 1*a*, which is arranged at the edge of the housing bottom 1*b*. A lid (not shown in FIG. 1 is conventionally arranged on the upper side of the housing 1. Inside the housing there are four resonators R1, R2, R3 and R4 arranged next to one another, which are formed in square cavities with rounded corners in the housing 1. Neighboring cavities are connected to one another via so-called coupling openings 3, 4 and 5. Each resonator R1, R2, R3 and R4 comprises cylindrical inner conductor tubes 2 arranged centrally in the respective cavity and sometimes also referred to below as inner conductors 2, which are positioned perpendicularly on the bottom 1*b*, the lower ends of the inner conductor tubes in the embodiment described here being DC-connected to the electrically conductive bottom 1*b* of the housing 1. Between the inner conductors 2 and the walls of the resonator cavities, there is a dielectric which in the embodiment described here is air. The mechanical length of the inner conductor tubes in the filter shown is ¼ of the electrical wavelength of the resonant frequency of the respective resonator.

Neighboring resonators are electrically coupled to one another via the openings 3, 4 and 5. The coupling openings represent apertures, which are respectively bounded laterally by two opposite projections 6, 7 and 8 in the housing 1. The electrical coupling between the neighboring resonators can be influenced via the size of the apertures 3, 4 and 5. It can be seen in FIG. 1 that the openings 3, 4 and 5 are differently configured, and in particular the central coupling opening 4 has a smaller width in the longitudinal direction X and in the transverse direction Y of the housing than the coupling openings 3 and 5. The smaller width is caused by the projections 7, which are narrower than the projections 6 and 8 and extend further into the housing interior.

The electrical coupling between the resonators is influenced in particular by the width of the coupling openings in the transverse direction Y. In this case, the coupling between the individual resonators is increased by enlarging the aperture opening. This property is utilized in the production of the radiofrequency filter in order to compensate for tolerances, which occur when making the molding tool for the outer conductor housing or during the actual process of molding or machining the outer conductor housing. Since only an increase in the coupling between neighboring resonators can be achieved by widening the aperture opening, in the embodiment of the filter according to the invention described here the coupling between the resonators is furthermore influenced by circular indentations or depressions 9. This uses the discovery that indentations in the outer conductor bottom between neighboring resonators—in contrast to widening the aperture openings—leads to attenuation of the electrical coupling. By corresponding shaping of the depressions or different depths of the depressions, manufacturing tolerances which lead to strong coupling of the resonators can therefore be compensated for in a straightforward way.

In contrast to known filters, the filter according to the invention is substantially easier to produce. In the case of known filters, the coupling openings first need to be made too small so that the electrical coupling can be adjusted to the desired degree by successively re-machining the openings, since there is no way that excessively strong electrical coupling due to too large an aperture opening can be attenuated again. The production method is therefore very time-consuming and, with excessive widening of the coupling opening, immediately leads to loss of the entire filter housing. Compared with this, production of the filter according to the invention is substantially simpler since too large a coupling opening can be compensated for again by applying the indentations 9 in the housing bottom. The outer conductor housing can thus be manufactured initially with the desired size of the coupling openings, and any manufacturing tolerances can then be compensated for iteratively either by widening the coupling opening further or by applying corresponding indentations. The indentations are in this case preferably machined into the bottom of the outer conductor housing by corresponding machining tools. It is, however, also possible to bore the indentations into the housing bottom with a boring tool.

Figure 2:
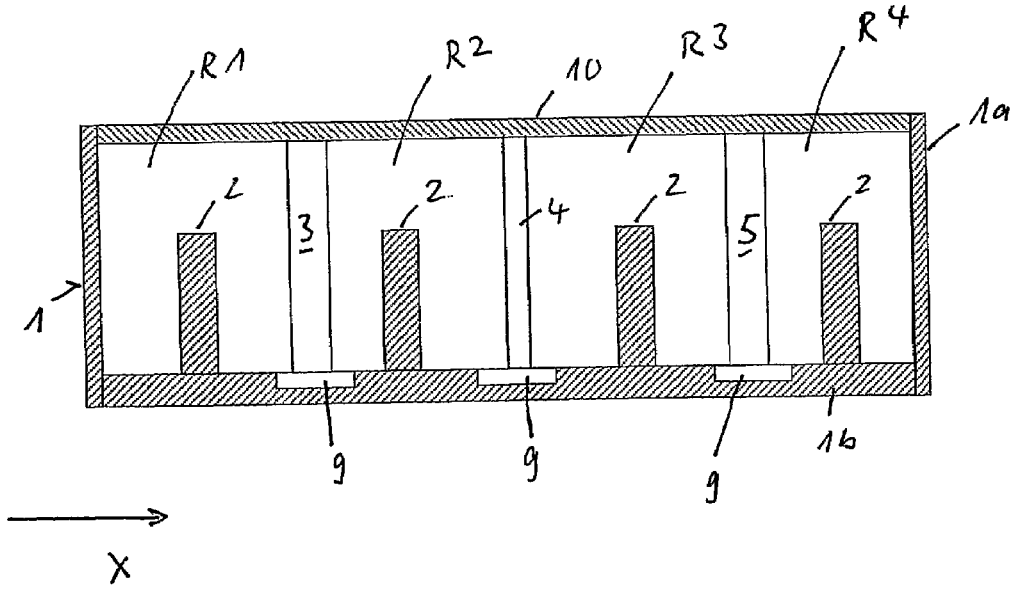
FIG. 2 shows a section of view along the line I-I of the filter in FIG. 1.

FIG. 2 shows a sectional view along the line I-I in FIG. 1, although for the sake of better representation the inner conductor tubes 2 are not shown in the section, rather their full area is depicted by shading. The representation according to FIG. 2 furthermore depicts the metallically conductive lid 10, which is put onto the upper side of the outer conductor housing 1. A capacitor, which has an effect on the resonant frequency, is therefore formed between the individual inner conductor tubes 2 and the lid 10 in the radiofrequency filter. If the distance between the free upper end of the inner conductor tubes 2 and the lid 2 is very small, then dielectric layers which cover the cross section of the inner conductor tubes, in plan view of the filter, may furthermore be provided in the inner side of the lid 10. In this way, an increase in the capacitance and a reduction in the resonant frequency can be achieved without having to increase the overall volume. Furthermore, the breakdown strength between an inner conductor tube and the lid is improved.

From FIG. 2, is apparent in particular that the individual inner conductor tubes 2 are DC-connected to the bottom 1*b* of the housing 1. In such a resonator, the magnetic field during operation is maximal at the lower end of the inner conductor tube and minimal at the upper end of the inner conductor tube. Conversely, the electrical field is maximal at the upper end of the inner conductor tube and minimal at the lower end of the inner conductor tube. It can furthermore be seen that the aperture opening 4 has a smaller width in the X direction than the openings 3 and 5. It is furthermore apparent that the indentations 9 in the embodiment described here are cylindrically configured and extend almost to the outside of the housing bottom 1*b*. By such indentations, strong attenuation of the coupling between neighboring resonators is achieved. The geometrical shape and depth as well as the length of the individual indentations may be variable. Instead of circular indentations, elongate indentations in the form of a groove or rectangular indentations may also be used. These indentations may furthermore have different depth profiles, and in particular the side walls of the indentations may taper downward, which in the case of a circular indentation leads to a conical profile shape of the indentation. Alternatively, the indentations may naturally also widen downward. Furthermore, a plurality of indentations may also be arranged between two neighboring inner conductor tubes 2. The indentations may in this case be arranged next to one another in the X direction and/or next to one another in the Y direction and/or mutually offset, and they may all have the same shape or some the same shape or all different shapes.

Said indentations or depressions 9 may also be provided in the housing bottom 1*b*, above all in the region of the coupling opening, to achieve the desired advantages when for example the housing bottom 1*b* lies at a different level here, for example by forming a threshold, step or a kind of pedestal, as immediately next to the inner conductors. To this extent, reference is made to the previously published U.S. Pat. No. 4,307,357.

Figure 3:
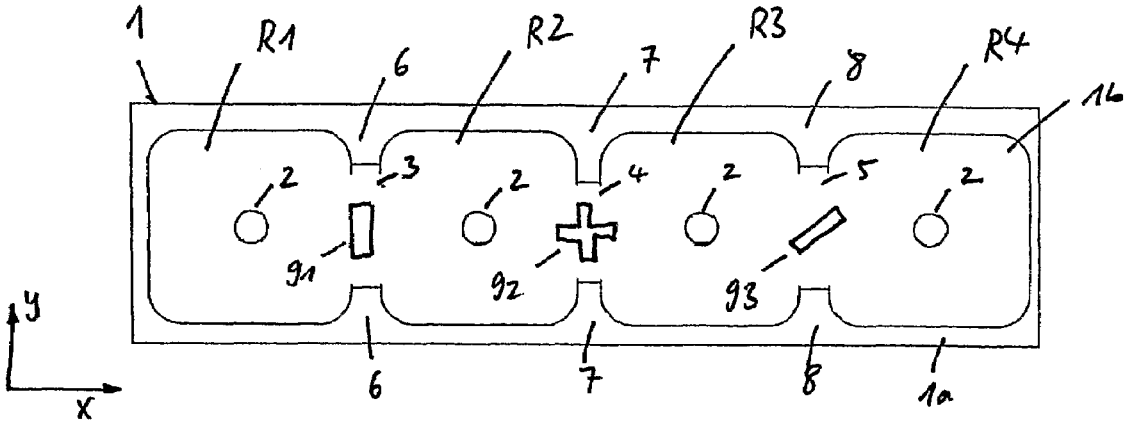
FIG. 3 shows a plan view of an alternative embodiment of a radiofrequency filter according to the invention.

FIG. 3 shows a similar view to FIG. 1 of a radiofrequency filter, the indentations of which have different shapes. In this case an elongate indentation 91, which extends in the Y direction, is provided between the resonators R1 and R2. A star-shaped indentation 92 is formed between the resonators R2 and R2 and an obliquely extending elongate indentation 93 is arranged between the resonators R3 and R4. All the indentations 91, 92 and 93 in this case lie fully or partially inside the coupling openings between the neighboring resonators.

Figure 4:
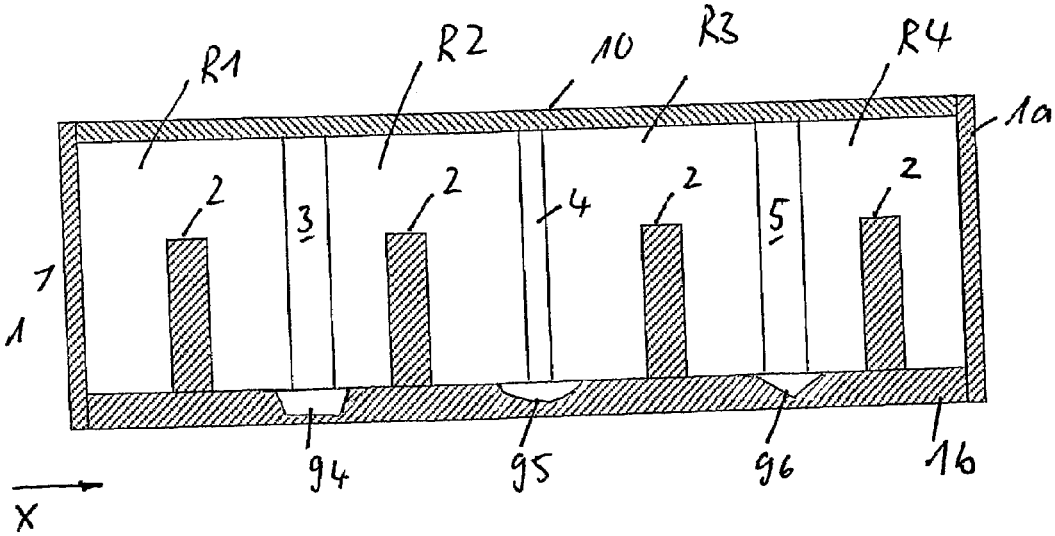
FIG. 4 shows a sectional view similar to FIG. 2 of another embodiment of a radiofrequency filter according to the invention.

FIG. 4 shows a similar view to FIG. 2, a filter being shown with different depth profiles of the indentations. The indentation 94 between resonators R1 and R2 is in this case configured conically downward, while the indentation between resonators R2 and R3 has the shape of a spherical cap. Conversely, the indentation 96 between resonators R3 and R4 has a V-shaped profile. All the geometrical shapes, positions and profiles described above for the indentations are merely exemplary, and any shapes, alignments and profile configurations are possible, which may also be combined with one another in any way.

With the aid of FIGS. 5 and 6, it is furthermore shown merely for illustration that the bottom surface 1*b*, 1*b*' may also extend at a different level in different regions of the radiofrequency filter. This applies optionally to the height level of the individual bottom surfaces 1*b* in each individual resonator in the immediate vicinity of the inner conductor 2, but above all in the region of the coupling opening. The coupling opening may be formed here so that it lies over the other level of the housing bottom 1*b*, so that a kind of step, threshold or a kind of pedestal is formed particularly in the region of the coupling opening 3, so that the upwardly facing bottom surface 1*b*, which is referred to here as the housing bottom 1*b*', lies higher than neighboring sections of the housing bottom provided with the reference 1*b*.

The width in the coupling direction of this higher-lying bottom 1*b*' may, for example, correspond to the housing width of the coupling opening. In FIG. 5, however, it is indicated in dashes that the bottom surface 1*b*' may also have a greater width or lengthwise extent, which extends beyond the thickness of the neighboring housing wall 1' i.e. the thickness of the housing wall 1' next to the coupling opening 3. Said recesses of the indentation 9 are likewise provided and introduced in this high-lying level of the bottom surface 1*b*, 1*b*', in order to achieve said desired improvements.

The invention claimed is:

1. A coaxial radio frequency filter, comprising:

an outer conductor housing with a housing bottom and a housing wall, a neighboring plurality of resonators formed in the outer conductor housing, the resonators respectively comprising an inner conductor, to the housing bottom, which is provided in an associated cavity in the outer conductor housing, the cavities of at least some of neighboring plurality of resonators are connected to one another via at least one coupling opening in the outer conductor housing, and two neighboring resonators being electrically coupled to one another only by means of the coupling openings, and the coupling openings representing apertures, which are respectively bounded laterally by two projections lying opposite in the housing, the electrical coupling between neighboring resonators depending on the size of the apertures, wherein at least one indentation reducing the coupling in the housing bottom is formed between at least some of the inner conductor tubes of neighboring resonators coupled to one another.

2. The radio frequency filter according to claim 1, wherein the at least one indentations in plan view of the housing bottom lies next to a coupling opening and/or at least partially inside a coupling opening.

3. The radio frequency filter according to claim 2, wherein the areas of the indentations in plan view of the housing bottom dimensioned and/or are arranged so that their areas lie at least between 80% and 100% inside the region of the relevant coupling openings.

4. The radio frequency filter according to claim 1, wherein between at least some of the inner conductors of neighboring resonators, a plurality of indentations are formed which are arranged next to one another in the longitudinal direction of the outer conductor housing and/or next to one another in the transverse direction of the outer conductor housing and/or mutually offset in the longitudinal and/or transverse direction of the outer conductor housing.

5. The radio frequency filter according to claim 1, wherein a plurality of the indentations are provided, of which individual indentations are different and differ in geometrical shape, depth and/or depth profile.

6. The radio frequency filter according to claim 1, wherein one or more of the indentations are rectangular, in particular square, in plan view of the housing bottom.

7. The radio frequency filter according to claim 1, wherein one or more of the indentations are circular or have a star-like shape in plan view of the housing bottom.

8. The radio frequency filter according to claim 1, wherein one or more of the indentations have a V-shaped and/or U-shaped depth profile.

9. The radio frequency filter according to claim 1, wherein the depth profile of one or more of the indentations tapers and/or widens downward.

10. The radio frequency filter according to claim 1, wherein one or more of the indentations have a cylindrical and/or conical and/or spherical cap-shaped depth profile.

11. The radio frequency filter according to claim 1, wherein one or more of the indentations are bores and/or machined holes in the housing bottom.

12. The radio frequency filter according to claim 1, wherein at least some of the inner conductor tubes are DC-connected to the housing bottom at their lower ends.

13. The radio frequency filter according to claim 1, wherein at least some of the inner conductors have a cylindrical and/or rectangular and/or hexagonal or polygonal shape.

14. The radio frequency filter according to claim 1, wherein the length of at least some of the inner conductors is essentially ¼of the wavelength of the resonant frequency of the resonator belonging to the inner conductor tube.

15. The radio frequency filter according to claim 1, wherein an electrically conductive lid is arranged on the upper side of the outer conductor housing.

16. The radio frequency filter according to claim 1, wherein the resonators are configured and coupled so that a duplex switch is formed.

17. The radio frequency filter according to claim 1, wherein the resonators are designed and coupled so that a bandpass filter or a bandstop filter is formed.

18. The radio frequency filter according claim 1, wherein a filter is configured so that it operates in the mobile radio frequency range, particularly in the GSM and/or UMTS mobile radio frequency range.

19. The radio frequency filter according to claim 1, wherein the housing bottom in the radiofrequency filter lies locally at a different level higher or lower in the region of the indentations or depressions relative to the neighboring regions of the housing bottom, relative to the level of the housing bottom in the region immediately neighboring the inner conductor.

20. A method for tuning the radiofrequency properties of a radiofrequency filter which comprises a plurality of resonators, the radio frequency filter of the type comprising an outer conductor housing with a housing bottom and a housing wall, in which a plurality of resonators are formed which respectively comprise an inner conductor electrically coupled to the housing bottom, at least some of neighboring resonators being electrically coupled to one another via at least one coupling opening in the outer conductor housing, comprising:

forming at least one indentations in the housing bottom between at least some of the inner conductors of neighboring resonators, and using the indentations to attenuate the electrical coupling of neighboring resonators.

21. Method according to claim 20, further including machining the at least one indentation in the housing bottom.

22. Method according to claim 20, further including enlarging at least one coupling openings in the outer conductor housing in order to reinforce the electrical coupling of neighboring resonators.

23. Method according to claim 20, further including boring a plurality of indentations into the housing bottom, of which at least individual indentations have a different geometrical shape and/or different depth and/or a different depth profile.

* * * * *